US005390912A

United States Patent [19]

Silagy

[11] Patent Number: 5,390,912

[45] Date of Patent: Feb. 21, 1995

[54] BASKETBALL SHOOTING TARGET FOR GAME CONDITION USE

[76] Inventor: Howard Silagy, 100A Tec St., Hicksville, N.Y. 11801

[21] Appl. No.: 292,250

[22] Filed: Aug. 18, 1994

[51] Int. Cl.[6] ..... A63B 63/08

[52] U.S. Cl. ..... 273/15 A

[58] Field of Search ..... 273/1.5 A, 1.5 R, 402, 273/400

[56] References Cited

U.S. PATENT DOCUMENTS

| | | | |
|---|---|---|---|
| 4,206,915 | 6/1980 | Woodcock | 273/1.5 A |
| 4,244,569 | 1/1981 | Wong | 273/1.5 A |
| 4,506,886 | 3/1985 | Lamb, Sr. | 273/1.5 A |
| 4,836,539 | 6/1989 | Knapp | 273/1.5 A |
| 4,915,381 | 4/1990 | Hackett | 273/1.5 A |

*Primary Examiner*—Paul E. Shapiro

[57] ABSTRACT

At least one target for sighting during execution of an intended non-backboard banked basketball shot in which the target, in the specific form of a brightly colored ball, is attached to a cord of the net supported in depending relation from the rim, in which location it does not prevent also a "dunk" shot, i.e. not a shot requiring a target but nevertheless commonly used in scoring, such that all varieties of shots are possible with the within target permitting its use under game conditions and with the pressure to the user attendant therewith.

1 Claim, 2 Drawing Sheets

BASKETBALL SHOOTING TARGET FOR GAME CONDITION USE

The present invention relates to improvements in a basketball target device, the improvements more particularly enabling the use of the device under actual game conditions to thereby place the user under the pressure of a defending opposing player and correspondingly contributing to enhancing proficiency during more realistic and meaningful circumstances.

EXAMPLES OF THE PRIOR ART

It is already well known to use a sighting target to teach the proper trajectory for a basketball shot, the attached association of the target to the basketball hoop taking various forms as exemplified by U.S. Pat. No. 4,244,569 issued to Wong for "Basketball Practicing Apparatus" on Jan. 13, 1981, U.S. Pat. No. 4,506,886 issued to Lamb Sr. for "Basketball Practice Apparatus" on Mar. 26, 1985, and U.S. Pat. No. 4,915,381 issued to Hackett for "Basketball Target Device" on Apr. 10, 1990.

Applicable to the above referenced, and all known basketball shooting targets, and using the Hackett basketball target by way of a specific example, the target is located centrally of the circular rim of the basketball hoop structure, and is presented in a bright color to serve as a visual sighting object for enhancing the proficiency of a scoring basketball shot delivered in a trajectory for passage through the rim. The location specifically selected to be central of the circular rim is consistent with an effort to teach the noted trajectory shot from all angles relative to the target, i.e. from opposite corners of the court, center court, etc., thus, according to the prior art practice, obviating any need to change the target location since it is at the center of the rim and in this location thought to be appropriate as a sighting target no matter where on the playing court the trajectory shot originates from.

Underlying the present invention is the recognition that proficiency in making a basketball trajectory score is not demonstrated unless acquired under game pressure when an attempt is of course being made to prevent the score. The prior art practice targets or devices using a rim centrally located sighting target are appropriate only for non-game practice sessions, and thus are inadequate in the important respect noted.

Broadly, it is an object of the present invention to provide a basketball trajectory shot teaching aid overcoming the foregoing and other shortcomings of the prior art.

More particularly, it is an object to provide a teaching aid or target for basketball trajectory shooting, which does not impede taking lay-ups, executing "slam dunks" and other varieties of scoring shots, thereby contributing to advantageous use of the within inventive basketball target during the actual playing of a basketball game, and thus with the attendant benefits thereof, all as will be fully explained as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
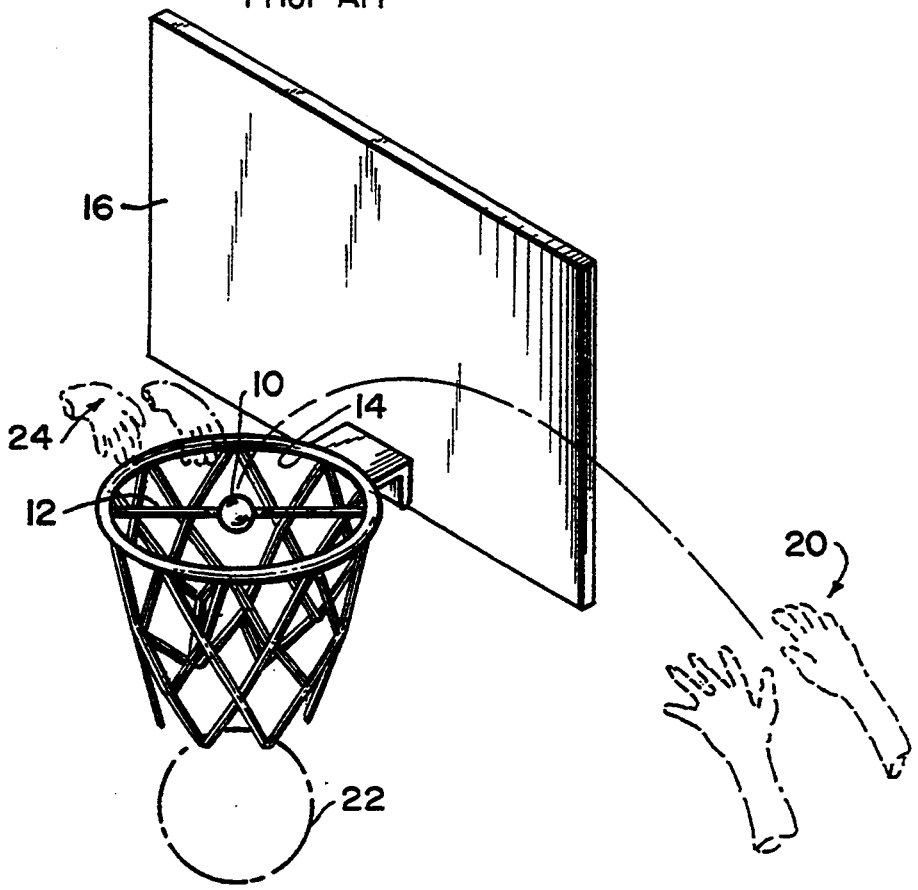
FIG.1 Prior Art
FIG. 1 is a perspective view of a prior art basketball shooting target, including illustrations in phantom perspective of exemplary shots denominated in basketball parlance as a "jump shot" and "dunk"

It is already well known, as documented by the noted Hackett patent and as illustrated in FIG. 1, that a brightly colored ball 10 attached midway on a cord 12 positioned along the diameter of a hoop or rim 14 can effectively serve as a visual sighting object for enhancing the proficiency of a scoring basketball shot delivered in a trajectory for passage through the rim 14, the referenced shot being typically known in basketball parlance as a "swish" shot because optimumly it isn't banked off the backboard 16 but passes or "swishes" through the net 18 mounted in depending relation about the rim 14.

Using the prior art target 10 mounted centrally in the area bounded by the rim 14 is consistent with the concept that it function as a visual sighting object from all angles relative thereto, i.e. from opposite corners of the basketball court, counter court, etc., for a "swish" shot. However, and as illustrated in phantom perspective in FIG. 1, other varieties of shots, known in basketball parlance as a short jump shot, depicted by reference numeral 20, and even more significantly a so-called "dunk" shot in the execution of which the basketball 22 is forced through the net 18 with a manual thrust, depicted by the reference numeral 24, are obviously impeded by the rim opening-blocking position of the target ball 10. Resiliency of the cord 12 does not obviate entanglement with the user's hand executing the manual thrust 24 of a "dunk" shot.

Underlying the present invention is the recognition that training for a "swish" shot is best provided under game conditions, i.e. under the pressure of a defending opposing player, and for such game conditions the aiming target correspondingly cannot preclude the taking of all varieties of shots that would occur incident to its use during a practice game, which is a shortcoming of all known basketball target devices.

The aforesaid is implemented according to the present invention by use of a selected one or more brightly colored plastic balls, designated 30 in FIG. 3, supported 3–4 inches below the rim 32 (FIG. 4) on a cooperating strand 34 of the net 36, and by reason of its support position on the net being necessarily in a clearance position in relation to a central path through the rim 32 and the net 36 strung in depending relation about the rim 32. This clearance position of the target balls, for the selected 5 such balls 30A, 30B, 30C, 30D, and 30E of FIG. 4, does not interfere or otherwise adversely effect the taking of non-swish shots, and thus the net-mounted target balls 30A-E are advantageously used in actual practice games, and thus with the attendant benefits thereof.

Figure 2:
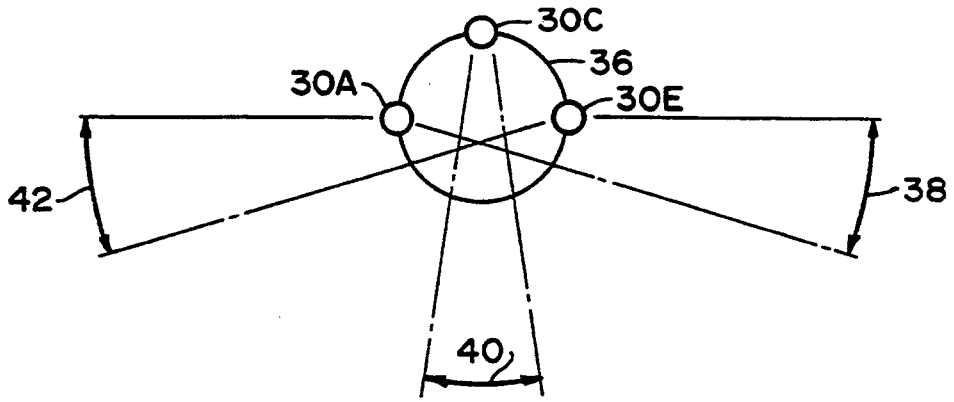
FIG. 2 is a schematic plan view illustrating the origination on the basketball court of so-called "swish" or non-backboard shots using the within basketball shooting or aiming device.

For completeness' sake it is noted in reference to the schematic plan view of FIG. 2 that the target balls 30A, 30C and 30E are positioned on the far side of the net 36, from the perspective of the shooter, so that ball 30A is the appropriate visual target for a right corner shot originating from the area 38, ball 30C for a center court shot from area 40, and ball 30E for a left corner shot from area 42.

Figure 3:
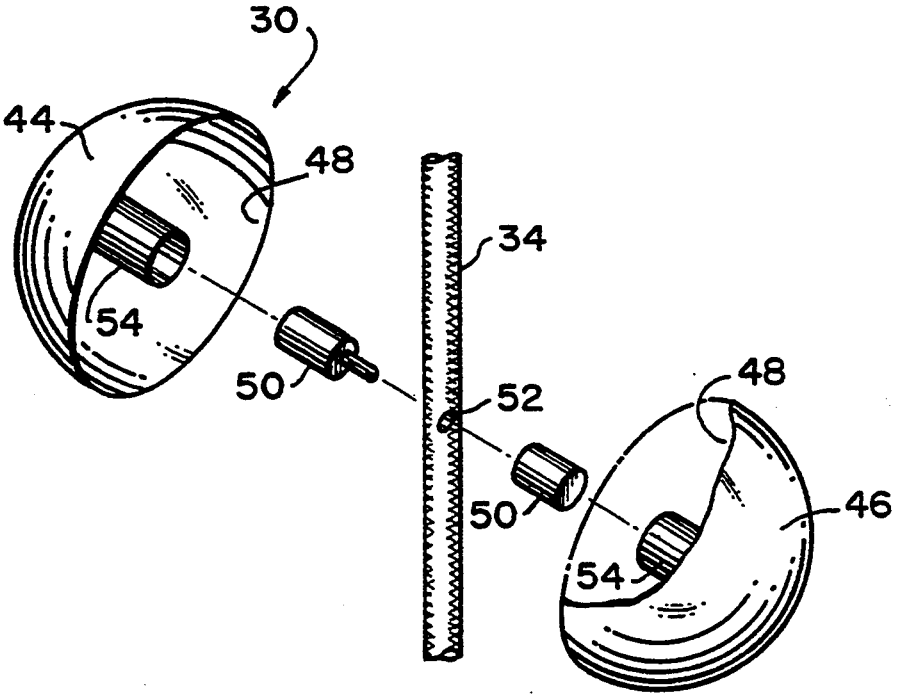
FIG. 3 is an exploded view, in an enlarged scale, of a ball used as a sighting target.
Figure 4:
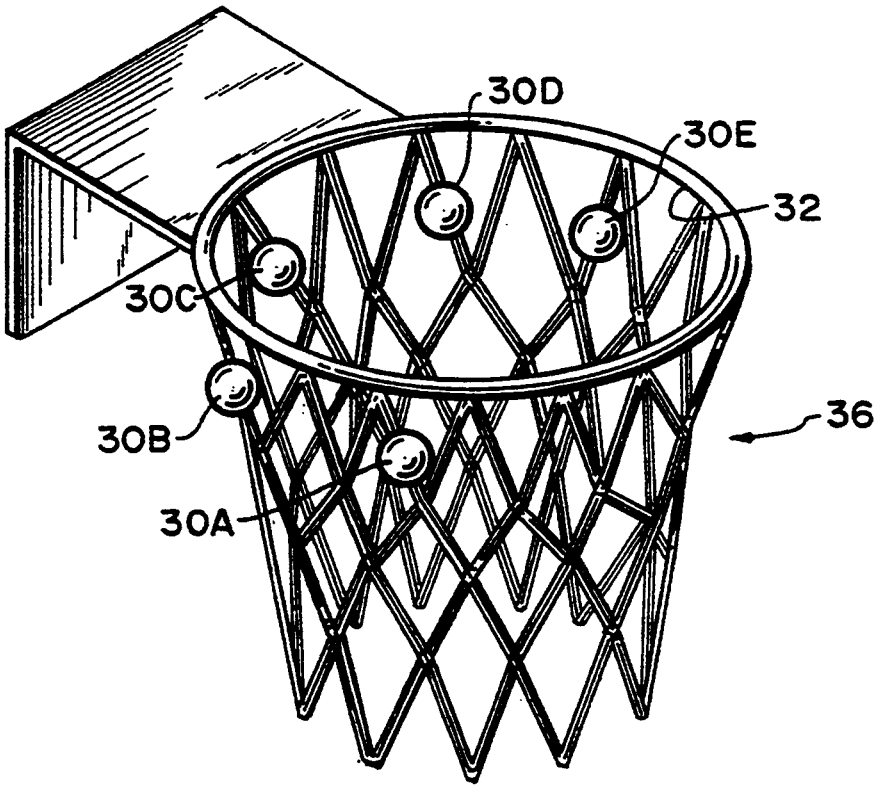
FIG. 4 is a perspective view of the within aiming device comprised of a selected number (5) of the target balls of FIG. 3.

In a preferred embodiment, and as best illustrated in FIG. 3, each target ball 30 is of plastic construction material formed as two half spheres 44 and 46, the inner diameters 48 being sized to provide a friction fit when closed upon each other. Prior thereto, however, a two-piece pin 50 is engaged to a cooperating net strand 34 at the site 52 so that opposite ends of the pin 50 project into hollow cylindrical tubes 54 integral with spheres 44, 46 during the closing together or interfitting connection of the spheres.

While the basketball aiming or shooting device herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed:

1. An aiming device in attached relation to a basketball hoop of a type consisting of a circular rim and a cylindrically shaped net formed by an arrangement of plural interconnected yarns connected in depending relation about said rim in the use of which a basketball is typically caused to pass through said net by a manual thrust therethrough and by a thrown trajectory, said aiming device comprising at least one target in the form of a small-sized circular ball, and a selected site for the attachment of said target ball being on a yarn of said net below said rim to serve as a visual sighting target for said thrown trajectory and in a position of clearance from said manual thrust, whereby said aiming device contributes to proficiency in scoring by a thrown trajectory without impeding scoring by a manual thrust and is thereby advantageous for game conditioning use.

* * * * *